United States Patent [19]

Norton et al.

[11] 4,287,675

[45] Sep. 8, 1981

[54] COUNTER FOR ATHLETIC SHOE

[75] Inventors: Edward J. Norton, Kingston, N.H.; Charles J. Flanagan, Melrose, Mass.

[73] Assignee: New Balance Athletic Shoe, Inc., Lawrence, Mass.

[21] Appl. No.: 112,916

[22] Filed: Jan. 17, 1980

[51] Int. Cl.[3] ..... A43B 13/42; A43B 5/06

[52] U.S. Cl. ..... 36/129; 36/68

[58] Field of Search ..... 36/68, 69, 71, 129, 36/132

[56] References Cited

U.S. PATENT DOCUMENTS 2,244,504 6/1941 Riddell ..... 36/68

2,638,689 5/1953 Stritter ..... 36/68

2,723,468 11/1955 Marcy ..... 36/68

*Primary Examiner*—Patrick D. Lawson

*Attorney, Agent, or Firm*—Pennie & Edmonds

[57] ABSTRACT

A counter for footwear, such as athletic shoes mounted on the sole of the footwear within the region of the heel and superposed on the lasted upper to extend toward the instep. The counter has a body contoured to extend around the heel and along the sides of the footwear and tapers from a maximum height at the heel toward the sole. The counter is formed of a stiff, relatively unyielding material. The medial side extends to the instep and together with the material of the body encourages normal range of motion to reduce running related injury.

8 Claims, 4 Drawing Figures

COUNTER FOR ATHLETIC SHOE

DESCRIPTION

1. Technical Field

The present invention is in a device in the form of a counter for use with footwear, such as athletic shoes, and particularly athletic shoes for runners, joggers and the like, for support and stabilization of the foot in the normal range of motion, and the reduction of pronation to reduce running related injury.

2. Background Art

Athletic shoes generally are fabricated from soft, pliable, light-weight materials, such as nylon, with little or no support to enable the individual to exercise without unnecessarily adding to the stress of the exercise through heavier, more rigid shoes. However, it is during this type of activity, such as running, jogging and the like, that the individual may require support around the foot to prevent injury to the joints.

The recognized cycle of foot movement during running, jogging and the like typically is found to be heel strike, ball strike, pronation, release and supination. It has been found that the nylon-type athletic shoe fails to provide the support necessary for the foot during activity of this type. Thus, the known athletic shoe fails in the support of the foot securely in a neutral plane and allows the foot, because of the natural flexibility of the material, to roll or pronate excessively during the cycle of movement. Running related injuries, not only to the ankle, but quite often to the knee and hip, may occur.

The counter of the present invention is extended to the region of the instep along at least the medial side of the athletic shoe to reduce pronation and thereby eliminate or at least reduce the incidents of running related injury. The counter may also be extended along the lateral side of the athletic shoe, and it has been found that the extended counter serves the purpose, even when used with the typical flexible athletic shoe, to secure the runner's foot in a neutral plane, encourage the normal range of motion within that plane, and reduce the amount of roll both to the medial or inside and lateral or outside. Thus, the extended counter overcomes the problems and disadvantages found to exist in prior athletic shoes.

DISCLOSURE OF THE INVENTION

The present invention relates to a counter for use with footwear, such as athletic shoes; and to footwear of the aforementioned type including a sole, an upper and a counter which is mounted to the sole within the region of the heel to be superposed on the upper along a medial and lateral side. The counter has a body including a wall which is contoured to extend around the region of the heel and along the side of the footwear. The upper edge of the wall is of maximum height at the rear of the heel and the edge tapers downwardly along a generally arcuate path toward the sole. The body is formed of a stiff, relatively unyielding material and at least the medial side of the body extends to the region of the instep to restrict movement of at least the heel to a normal range of movement to reduce injury caused by foot instability.

BEST MODE FOR CARRYING OUT THE INVENTION

The counter 10 (FIG. 3) and 12 (FIG. 4) comprise forms of counter which may be used with footwear, such as an athletic shoe 14 and, as shown in the Figures, find use with a right shoe. Counters of complementary outline (not shown) are provided for the left shoe.

The athletic shoe 14 which may be considered as being of a contruction well known in the art, and typically one used by runners, joggers and the like, may comprise a lasted upper 16 providing a foot receiving opening and securing laces, and a sole 18. As illustrated in both FIGS. 1 and 2, the athletic shoe is of the low-cut variety and the sole may be provided with a pattern of alternately high and low ridges of generally sinuous outline extending thereacross from the medial to the lateral side. Other patterned surfaces, provided for gripping, as is well known, may be provided.

Figure 1:
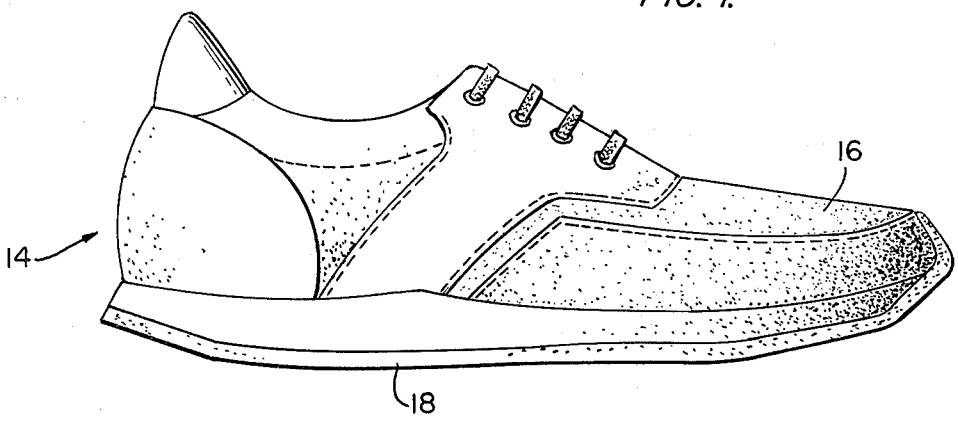
FIG. 1 is a view in elevation of the lateral side of an athletic shoe.
Figure 2:
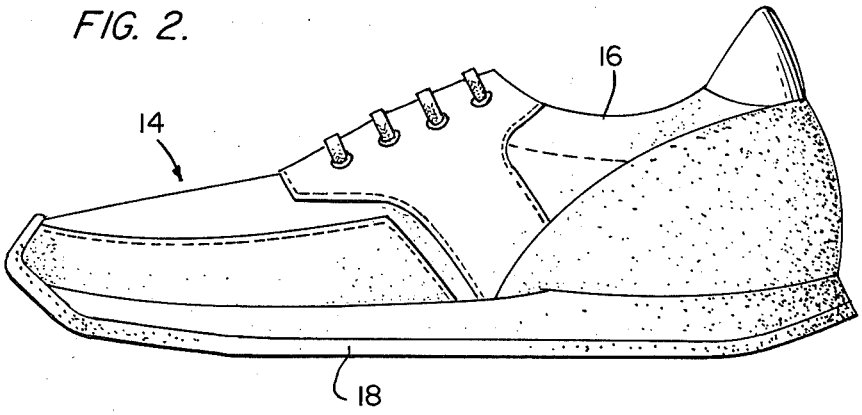
FIG. 2 is a view similar to FIG. 1 but illustrating the medial side of the same athletic shoe.
Figure 3:
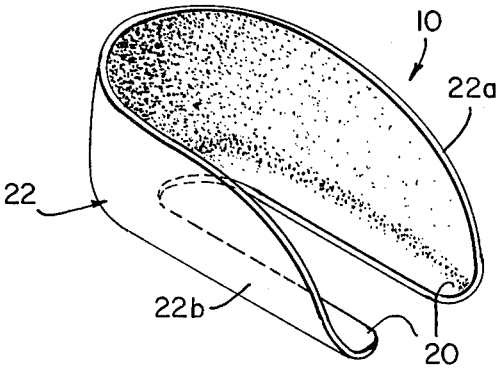
FIG. 3 is a perspective view of a counter of the present invention having both the lateral and medial sides of the counter extended.
Figure 4:
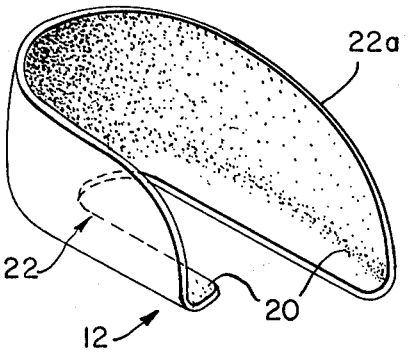
FIG. 4 is a view like that of FIG. 3 illustrating the extension of the medial side, only.

Referring to FIGS. 3 and 4, the counter 10, 12 includes a body having a base 20 of U-shaped outline and a wall 22 which is contoured generally to the shape of the heel. The sole 18 of the footwear and the inner surface of the wall as well as the upper surface of the base provides a mounting surface for the lasted upper 16. Thus, the counter 10, 12 may be disposed as illustrated in FIGS. 1 and 2 in superposed relation to the lasted upper.

The wall 22 of each counter has a medial side **22*a* which extends to the region of the instep of the athletic shoe and a lateral side 22*b* which either may be substantially coextensive or significantly shorter than the medial side, see FIGS. 3 and 4**, respectively. The walls of a counter for use with an athletic shoe for the other or left foot would be the reverse.

A shortening of the counter along the lateral wall so that it is not coextensive with the medial side may be desired to avoid any unnecessary interference with foot motion at the instep. The length and the height of the wall otherwise will be determined by the particular size of athletic shoe with which the counter is used.

Without any intent to limit the invention, but rather to more specifically describe a counter which has been found to provide desired results in the control of normal pronation, the counter may be formed of a plastic body to provide a stiff, relatively unyielding support in the region of the heel, thereby to restrict movement at least within that region to a normal range of movement. The body may be formed from various plastics, such as polyethylene, polyurethane and polystyrene or the equivalent. A body of a polyethylene has been used successfully. Any particular technique of formation of the body, such as molding the body of polyethylene may be employed; and the counter (10, 12) may be mounted on for support by the sole 18 with any type of adhesive, epoxy or the equivalent as suitable and desirable in this type of structure. The lasted upper will be similarly mounted.

In use, it is the function of the counter 10, 12 to control pronation. Most runners, joggers and the like follow a cycle of foot movement which may be characterized as heel strike, ball strike, pronation, release and supination. As used herein, the term "pronation" defines a foot roll to the medial or inside of the foot, and "supination" may be considered the rotation of a joint (hip, knee, ankle, and so forth) backward and away from the midline of the body. The counter situated as hereinbefore described provides a mechanical control to hold the runner's foot securely in a neutral plane, i.e., the natural position of the foot while in motion in a normal gait cycle, thereby to reduce the amount of roll of the foot which otherwise may result in, or be the cause of, running related injury to the foot, ankle, knee, and so forth. Further, the counter serves the function of reducing stress which runners may experience during the period of activity. The counter, also, permits the use of a more flexible training shoe, a shoe which otherwise may encourage, for example, foot roll and erratic gait.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

We claim:

1. For use in footwear, a counter adapted to be mounted on the sole of the footwear within the region of the heel and toward the instep and superposed on the upper of the footwear along a portion of the medial and lateral sides, said counter having a body including a wall which is contoured to extend around the region of the heel and along the sides of the footwear, an upper edge of said wall being of maximum height at the rear of the heel and in the mounted position following a downward inclined generally arcuate path toward the sole, at least the medial side of the body extended to the region of the instep, and said body being formed of a stiff, relatively unyielding material to restrict movement at least of the heel to a normal range of movement to reduce injury caused by instability.

2. The counter of claim 1 wherein said body is formed of plastic.

3. The counter of claim 2 wherein the body is formed of polyethylene.

4. The counter of claim 1 wherein both the medial and lateral sides of the body extend to the region of the instep.

5. Footwear including a sole, a lasted upper and a counter mounted on the sole within the region of the heel and toward the instep, said counter being superposed on the upper of the footwear along a portion of the medial and lateral sides, said counter having a body including a wall which is contoured to extend around the region of the heel and along the sides of the footwear, an upper edge of said wall being of maximum height at the rear of the heel and then following a downward inclined generally arcuate path toward the sole, at least the medial side of the body extended to the region of the instep, and said body being formed of a stiff, relatively unyielding material to restrict movement at least of the heel to normal range of movement to reduce injury caused by instability.

6. The footwear of claim 5 wherein said body of said counter is formed of plastic.

7. The footwear of claim 6 wherein the plastic laminate is polyethylene.

8. The footwear of claim 5 wherein both the medial and lateral sides of the body of said counter extend to the region of the instep.

* * * * *

UNITED STATES PATENT AND TRADEMARK OFFICE

CERTIFICATE OF CORRECTION

PATENT NO. : 4287675

DATED : September 8, 1981

INVENTOR(S) : Edward J. Norton
Charles J. Flanagan

It is certified that error appears in the above-identified patent and that said Letters Patent are hereby corrected as shown below:

Claim 7, line 1, after "the" insert --body of said counter--; delete "plastic laminate" and after "is" insert --formed of--.

Signed and Sealed this

*Seventeenth* Day of *November 1981*

[SEAL]

*Attest:*

GERALD J. MOSSINGHOFF

*Attesting Officer*

*Commissioner of Patents and Trademarks*